United States Patent [19]

Warner

[11] 4,446,690

[45] May 8, 1984

[54] BAR BALLOON CONTROL

[75] Inventor: Charles E. Warner, Spartanburg, S.C.

[73] Assignee: Milliken Research Corporation, Spartanburg, S.C.

[21] Appl. No.: 434,898

[22] Filed: Oct. 18, 1982

[51] Int. Cl.[3] ..... D01H 7/18; D02G 3/34; D02H 13/22; B65H 59/22

[52] U.S. Cl. ..... 57/284; 57/91; 57/283; 57/354; 242/150 M; 242/131

[58] Field of Search ..... 57/58.59, 58.7, 58.72, 57/58.83, 58.86, 90–94, 100, 127.5, 127.7, 206, 208, 264, 282, 283, 284, 351, 352, 354; 242/150, 131, 131.1

[56] References Cited

U.S. PATENT DOCUMENTS

| | | | |
|---|---|---|---|
| 2,624,527 | 1/1953 | Von Kohorn | 242/155 |
| 2,705,362 | 4/1955 | Roughsedge | 28/51 |
| 2,724,065 | 11/1955 | Saxl | 310/93 |
| 2,931,090 | 4/1960 | Field, Jr. | 28/1 |
| 2,946,177 | 7/1960 | Scragg et al. | 57/284 |
| 2,978,203 | 4/1961 | Westall et al. | 242/155 |
| 2,999,351 | 9/1961 | Davenport et al. | 57/140 |
| 3,011,736 | 12/1961 | Furst et al. | 57/352 X |
| 3,016,681 | 1/1962 | Andremont | 57/354 X |
| 3,022,025 | 2/1962 | Saxl | 242/155 |
| 3,047,932 | 8/1962 | Pittman et al. | 28/1 |
| 3,053,474 | 9/1962 | Luntz et al. | 242/150 M |
| 3,095,630 | 7/1963 | Pittman | 28/1 |
| 3,100,091 | 8/1963 | Mindheim et al. | 242/150 M |
| 3,106,442 | 10/1963 | Compostella et al. | 18/48 |
| 3,112,600 | 12/1963 | Stoddard et al. | 57/34 |
| 3,113,746 | 12/1963 | Steen | 242/155 |
| 3,152,436 | 10/1964 | Dudzik et al. | 57/157 |
| 3,194,000 | 7/1965 | Eldridge et al. | 57/34 |
| 3,352,511 | 11/1967 | Wiggins | 242/155 |
| 3,438,194 | 4/1969 | Cerutti et al. | 57/157 |
| 3,457,715 | 7/1969 | Eldridge et al. | 57/6 |
| 3,606,196 | 9/1971 | Heard | 242/155 M |
| 3,724,409 | 4/1973 | Olney, Jr. | 112/255 |
| 3,782,091 | 1/1974 | Spurgeon | 57/34 HS |
| 3,797,775 | 3/1974 | White | 242/155 M |
| 3,831,880 | 8/1974 | White et al. | 242/156 |
| 3,897,916 | 8/1975 | Rosen | 242/155 M |
| 4,035,879 | 7/1977 | Schippers | 28/246 |
| 4,112,561 | 9/1978 | Norris et al. | 57/91 X |
| 4,186,896 | 2/1980 | Brandenberger et al. | 242/131 |
| 4,313,578 | 2/1982 | Wilson et al. | 242/150 M |

*Primary Examiner*—Donald Watkins

*Attorney, Agent, or Firm*—Earle R. Marden; H. William Petry

[57] ABSTRACT

The apparatus includes a control between the electromagnetic tension control and the yarn supply package to prevent the yarn coming off the package from rotating in a full balloon path and consequently prevent entanglement of the yarn in the yarn guides to a yarn consuming machine. The balloon control basically employs a bar member under which the yarn passes as it is delivered to a yarn guide tube. The bar member prevents the yarn from rotating as it is taken off over-end from the yarn package thereby alleviating the possibility of yarn entanglement at the yarn tube.

3 Claims, 2 Drawing Figures

BAR BALLOON CONTROL

This invention relates generally to the employment of an electromagnetically actuated disc tension control to intermittently grasp and release a continuous filament synthetic yarn which is being processed downstream of the tension control.

It is an object of the invention to provide a yarn processing system which employs a disc tension control to randomly vary the tension of a yarn being processed in a yarn processing machine.

Figure 1:
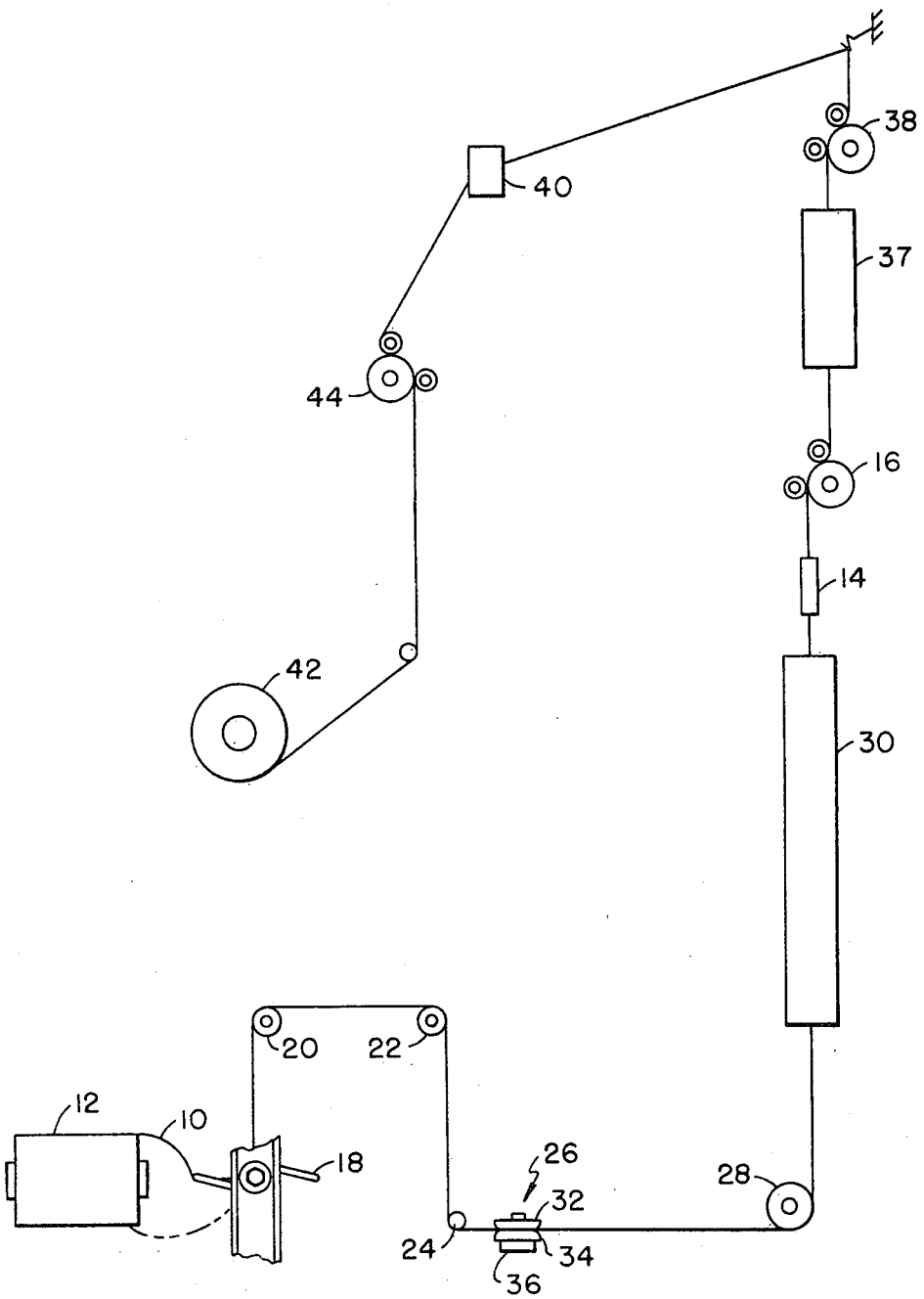
Figure 2:
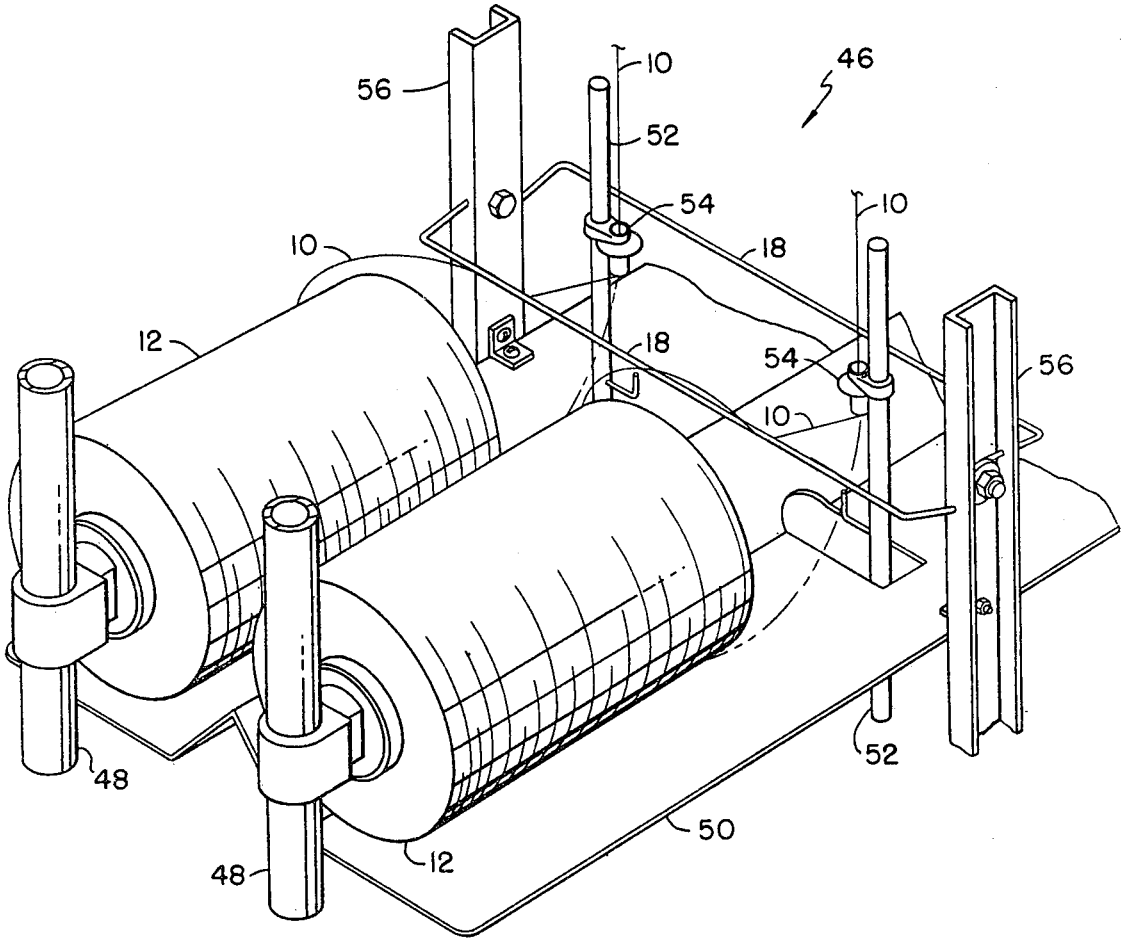

Other objects and advantages of the invention will become readily apparent as the specification proceeds to describe the invention with reference to the accompanying drawings, in which:

FIG. 1 is an overall schematic representation of the new and novel system to produce a textured, continuous filament synthetic yarn; and FIG. 2 is a partial perspective view of the yarn supply creel for the system shown in FIG. 1.

Looking now to FIG. 1, the overall system of FIG. 1 will be explained to obtain the novel disclosed yarn. The system is directed to a method to produce a specially textured yarn by intermittently varying the draw of a continuous filament partially oriented, synthetic, multifilament yarn such as polyester. The multifilament yarn 10 is supplied from a supply package 12 to the false twist device 14 by the feed roll device 16. The yarn 10 from the package 12 successively, in its travel to the feed roll device 16, passes through the balloon control apparatus 18, over the guide members 20, 22 and 24 through the electromagnetically controlled tension disc apparatus 26 and under the guide member 28 through the primary heater 30 and false twist device 14 to the feed roll device 16. The yarn 10 is intermittently and randomly drawn in the primary heater 30 by the intermittent hold back action of the disc tension apparatus 26. The discs 32 and 34 are intermittently and randomly drawn together and released on the yarn 10 by the action of the electromagnet 36 controlled by the varying voltage supplied thereto by a suitable voltage source which is varied by the action of a random signal generator.

From the feed roll device 16 the textured yarn passes through the secondary heater 37 with very little overfeed since the speed of the feed roll device 38 is substantially the same as the feed roll device 16 and the crimp in the yarn is allowed to set. Depending on the amount of crimp contraction desired the secondary heater can be either turned on at an appropriate temperature or off or by-passed and the overfeed varied from high to very little.

The feed roll device 38 is driven at a higher speed than the feed roll device 44 to overfeed the textured yarn through the air jet entangling device 40 to commingle and entangle the individual filaments of the textured yarn. From the feed roll device 38 the entangled, textured yarn is slightly overfed to the yarn take-up package 42 by the feed roll device 44.

Schematically in FIG. 1, the yarn package 12 and the balloon control element 18 are shown as separate items but in actual practice a creel unit, designated 46 in FIG. 2, is used. The creel unit 46 supports a plurality of packages 12 for a plurality of false twist spindle positions and is slid in and out of position relative to a multiple spindle false twisting machine. In FIG. 2 a partial creel is shown supporting a pair of supply packages held on creel pins supported by creel pin support members 48 that are connected to the creel. Also connected to the creel is a horizontal separation plate 50 through which the yarn guide supports 52 project. A yarn guide 54 for each yarn package is connected thereto to guide the yarn 10 from the package 12 towards the guide member 20. Mounted on both sides of the horizontal separator plate 50 is a channel beam 56 between which is connected the balloon control apparatus or bar 18. As shown in FIG. 2 the bar 18 prevents yarn 10 from the package 12 from forming a full balloon and getting entangled in and around various elements of the creel, such as yarn guides 54. As shown in FIG. 2, a second bar 18 is shown which is used for the same purpose for the yarn packages (not shown) on the opposite side of the creel unit 46.

In the form described hereinabove the preparation of a single end of multifilament synthetic yarn is described but, depending on the ultimate use of the yarn produced, a plurality of yarns can be interlaced or commingled in the air jet 40. Examples of such yarn are set forth below.

EXAMPLE 1

Two ends of a 240 denier, 68 filament DuPont 56T polyester yarn were processed as described above and commingled in the air jet 40 to provide a 2/150/68 yarn with an actual denier of 355. The elongation was 51% with a crimp contraction of 1%. The operating conditions were as follows:

| | |
|---|---|
| False Twist Spindle Speed | 96000 RPM |
| Yarn Speed through Spindle | 117 yards/minute |
| False Twist | 23 turns/inch |
| Twist Multiple | 306 |
| Direction | "S" |
| Yarn Overfeed Through Heater 37 | By-passed |
| Yarn Overfeed Through Air Jet | 4.0% |
| Yarn Overfeed to Take-Up | 1.7% |
| Temperature of Heater 30 | 180° C. |
| Temperature of Heater 37 | Off |
| High Pre-Spindle Tension Average | 50 grams |
| Low Pre-Spindle Tension Average | 12 grams |

The yarn thus produced has a very low crimp contraction with high luster and intermittent character.

EXAMPLE 2

Two ends of a 220 denier, 54 filament DuPont 693T polyester yarn were processed and entangled in the air jet 40 to provide a 2/150/54 yarn with an actual denier of 328. The elongation was 48% with a crimp contraction of 1.8%. The operating conditions were as follows:

| | |
|---|---|
| False Twist Spindle Speed | 129000 RPM |
| Yarn Speed through Spindle | 127 yards/minute |
| False Twist | 28 turns/inch |
| Twist Multiple | 359 |
| Direction | "S" |
| Yarn Overfeed through Heater 37 | 0 |
| Yarn Overfeed through Air Jet | 4.0% |
| Yarn Overfeed to Take-up | 1.7% |
| Temperature of Heater 30 | 180° C. |
| Temperature of Heater 37 | 190° C. |
| High Pre-Spindle Tension Average | 50 grams |
| Low Pre-Spindle Tension Average | 16 grams |

The yarn produced has a very low crimp contraction with very high luster and intermittent character.

EXAMPLE 3

One end of a 115 denier, 34 filament DuPont 693T polyester yarn was processed and entangled in the air jet 40 to provide a 1/70/34 yarn with an actual denier of 78. The elongation was 34% with a crimp contraction of 0.7%. The operating conditions were as follows:

| | |
|---|---|
| False Twist Spindle Speed | 269000 RPM |
| Yarn Speed through Spindle | 156 yards/minute |
| False Twist | 48 turns/inch |
| Twist Multiple | 424 |
| Direction | "S" |
| Yarn Overfeed through Heater 37 | 5.0% |
| Yarn Overfeed through Air Jet to Take-Up | 3.9% |
| Temperature of Heater 30 | 180° C. |
| Temperature of Heater 37 | 190° C. |
| High Pre-Spindle Tension Average | 35 grams |
| Low Pre-Spindle Tension Average | 15 grams |

This yarn has a very low crimp contraction and a very high luster.

It has been found that the most desirable low crimp, high luster yarn was produced when the twist multiple for the yarn is between 250–450. The twist multiple (TM) is equal to the turns per inch (TPI) of twist imparted to the yarn multipled by the square root of the yarn denier (Yd) ($TM = TPX \times \sqrt{Yd}$).

It can readily be seen that the described apparatus and method provides a randomly, intermittently textured, continuous multifilament synthetic yarn which along its length has variable bulk, torque, twist and shrinkage. The produced yarn has a low crimp contraction with a high luster. This yarn is especially useful in the fabrication of a velvet-type upholstery fabric and provides unique visual effects due to its variable dye affinity.

The yarn of Example 3 is especially useful in the fabrication of woven and knit fabrics and provides unique silk-like stria effects and hand.

Although the preferred embodiment of the invention has been described, it is contemplated that many changes may be made without departing from the scope or spirit of the invention and it is desired that the invention be only limited by the scope of the claims.

I claim:

1. Apparatus to produce a false twisted multifilament yarn comprising: yarn creel means, a false twist device, a heater means located between said yarn creel means and said false twist device, a disc type tension means located between said heater means and said yarn creel means to intermittently and randomly vary the flow of yarn from said creel means to said false twist device, a first means to supply yarn from said yarn creel means to said false twist device, a second means operatively associated with said yarn creel means to prevent the yarn from said yarn creel means being supplied to said false twist device from forming a full balloon path as the yarn is supplied from the yarn creel, said creel means including a creel pin adapted to support a yarn package and a yarn guide member, said second means including a bar member mounted on said creel means between said creel pin and said yarn guide member and a third means to supply false twisted yarn from said false twist device to a take-up means to take-up the false twisted yarn.

2. The apparatus of claim 1 wherein said creel means includes a plurality of creel pins, a pair of spaced apart vertically support members, said bar member being connected to said support members, said second means also including a second bar member connected to said support members.

3. The apparatus of claim 2 wherein an air jet commingling means is located between said third means and the take-up means to commingle the filaments of the yarn false twisted in said false twist device.

* * * * *